United States Patent [19]

Brockmanns et al.

[11] Patent Number: 4,976,099

[45] Date of Patent: Dec. 11, 1990

[54] SLIVER FEEDING AND OPENING DEVICE OF AN OPEN END SPINNING MACHINE

[75] Inventors: Karl-Josef Brockmanns, Willich; Theo Lembeck, Monchengladbach, both of Fed. Rep. of Germany

[73] Assignee: W. Schlafhorst & Co., Fed. Rep. of Germany

[21] Appl. No.: 500,362

[22] Filed: Mar. 28, 1990

[30] Foreign Application Priority Data

Mar. 30, 1989 [DE] Fed. Rep. of Germany ..... 3910292

[51] Int. Cl.[5] ..... D01H 4/30; D01H 4/32; D01H 4/36; D01H 4/38

[52] U.S. Cl. ..... 57/411; 57/301; 57/304; 57/412

[58] Field of Search ..... 57/301, 302, 304, 305, 57/411, 412, 413, 415

[56] References Cited

U.S. PATENT DOCUMENTS

| | | | |
|---|---|---|---|
| 3,360,917 | 1/1968 | Kubovy et al. | 57/411 |
| 3,800,520 | 4/1974 | Schiltknecht | 57/411 |
| 3,834,145 | 9/1974 | Ellingham et al. | 57/301 |
| 3,892,063 | 7/1975 | Doudlebsky et al. | 57/301 |
| 3,943,690 | 3/1976 | Noguera | 57/411 |
| 4,201,037 | 5/1980 | Artzt et al. | 57/301 |
| 4,314,440 | 2/1982 | Onoue et al. | 57/304 X |
| 4,495,762 | 1/1985 | Junek et al. | 57/301 X |
| 4,539,808 | 9/1985 | Miyamoto et al. | 57/415 X |
| 4,676,059 | 6/1987 | Artzt et al. | 57/411 X |
| 4,852,340 | 8/1989 | Kotrba et al. | 57/301 |

*Primary Examiner*—John Petrakes

*Attorney, Agent, or Firm*—Shefte, Pinckney & Sawyer

[57] ABSTRACT

A sliver feeding and opening device includes an outlet opening for passage of separated fibers to the rotor and an intake opening for the intaking of sliver to be separated into fibers. An intermediate opening is disposed in the chamber of the housing of the device at a location downstream of the outlet opening and upstream of the intake opening. An air stream reduction conduit extends from the intermediate opening to the outlet passage. The intermediate opening and the air stream reduction conduit conduct air from a revolving stream of air which revolves in the space between the opening roller and the cylindrical wall of the housing of the sliver feeding and opening device to prevent the revolving stream of air from detrimentally interfering with the orderly feeding of sliver at the intake opening to the opening roller.

6 Claims, 4 Drawing Sheets

SLIVER FEEDING AND OPENING DEVICE OF AN OPEN END SPINNING MACHINE

BACKGROUND OF THE INVENTION

The present invention relates to a sliver feeding and opening device for an open-end spinning machine.

The sliver feeding and opening device of an open-end spinning machine typically includes an opening roller rotatably disposed within a generally cylindrical chamber for combing incoming sliver to effect separation and parallel orienting of individual sliver fibers. The generally cylindrical chamber is formed in a housing which also includes an intake opening for the intaking of sliver therethrough and, at a location circumferentially spaced from the intake opening with respect to the generally cylindrical chamber, an outlet opening for the discharge of separated and generally parallel oriented sliver fibers. Due to the relatively high rate of rotation of the opening roller, a stream of air is created which revolves concentric with the opening roller within the region between the outer circumference of the opening roller and the inner wall of the generally cylindrical chamber.

The revolving stream of air can create operational problems in that it can prevent the incoming sliver from being presented at a preferred orientation relative to the opening roller for combing thereby. Specifically, it is generally preferable that the fibers of the incoming sliver be presented generally in a radial orientation with respect to the opening roller upon entering the housing through the intake opening. However, the revolving stream of air tends to disrupt the orderly feeding of the sliver to the opening roller through the intake opening by displacing some of the incoming sliver fibers in orientations displaced from the preferred radial orientation, thereby decreasing the effectiveness of the opening roller in combing the sliver fibers. The revolving stream of air additionally disrupts the sliver opening and feeding operation in that it entrains some of the sliver fibers, carries these fibers upstream beyond the outlet opening and causes the fibers to collide with incoming sliver fibers in the vicinity of the intake opening.

Accordingly, the need exists for a sliver opening and feeding device which minimizes the negative action of the revolving stream of air on the sliver feeding and opening operation.

SUMMARY OF THE INVENTION

The present invention provides a sliver feeding and opening device for an open end spinning machine which minimizes the undesirable effects of a revolving stream of air on the sliver feeding and opening operation.

Briefly described, the present invention provides a sliver feeding and opening device for feeding separated sliver fibers to the rotor of an open-end spinning machine. The device includes a housing having an interior chamber with a generally cylindrical wall, an intake opening for the intake of sliver into the chamber housing and an outlet passage means extending from the housing chamber to the rotor for the passage therethrough of separated sliver fibers which become entrained in an outlet stream of air flowing from the housing chamber to the rotor in response to a pressure differential therebetween, the outlet passage means including an outlet opening at the chamber wall. The sliver feeding and opening device additionally includes an opening roller having an axis and rotatably disposed in the housing chamber concentric with the wall and rotatable in an opening direction to effect opening of sliver following the intaking thereof through the intake openinq during transport of the sliver to the outlet opening, the rotation of the opening roller producing a stream of air revolving concentrically with the opening roller and the wall in the region between the opening roller and the wall. The sliver feeding and opening device further includes an intermediate opening in the chamber wall at a location downstream of the outlet opening and upstream of the intake opening with respect to the opening direction, and an air stream reduction conduit extending from the intermediate opening to the outlet passage means for conducting air from the revolving stream of air to the outlet passage means.

The air stream reduction conduit preferably extends at an acute angle from the outlet passage means with respect to the outlet stream of air to facilitate the smooth entry of air conducted by the air stream reduction conduit into the outlet passage means. Additionally, the intermediate opening preferably has a longitudinal extent substantially equal to the axial extent of the opening roller and parallel to the axis of the opening roller.

The air stream reduction conduit extends from the intermediate opening generally in the direction of a line extending through the axis of the opening roller and generally perpendicular to a tangent of the chamber wall at the intermediate opening location.

According to one aspect of the present invention, the radial extent of the region between the outlet opening and the intermediate opening with respect to the opening roller is substantially constant and the radial extent between the intermediate opening and the opening roller is less than the radial extent of the region between the outlet opening and the intermediate opening.

DETAILED DESCRIPTION OF THE PREFERRED EMBODIMENTS

Figure 1:
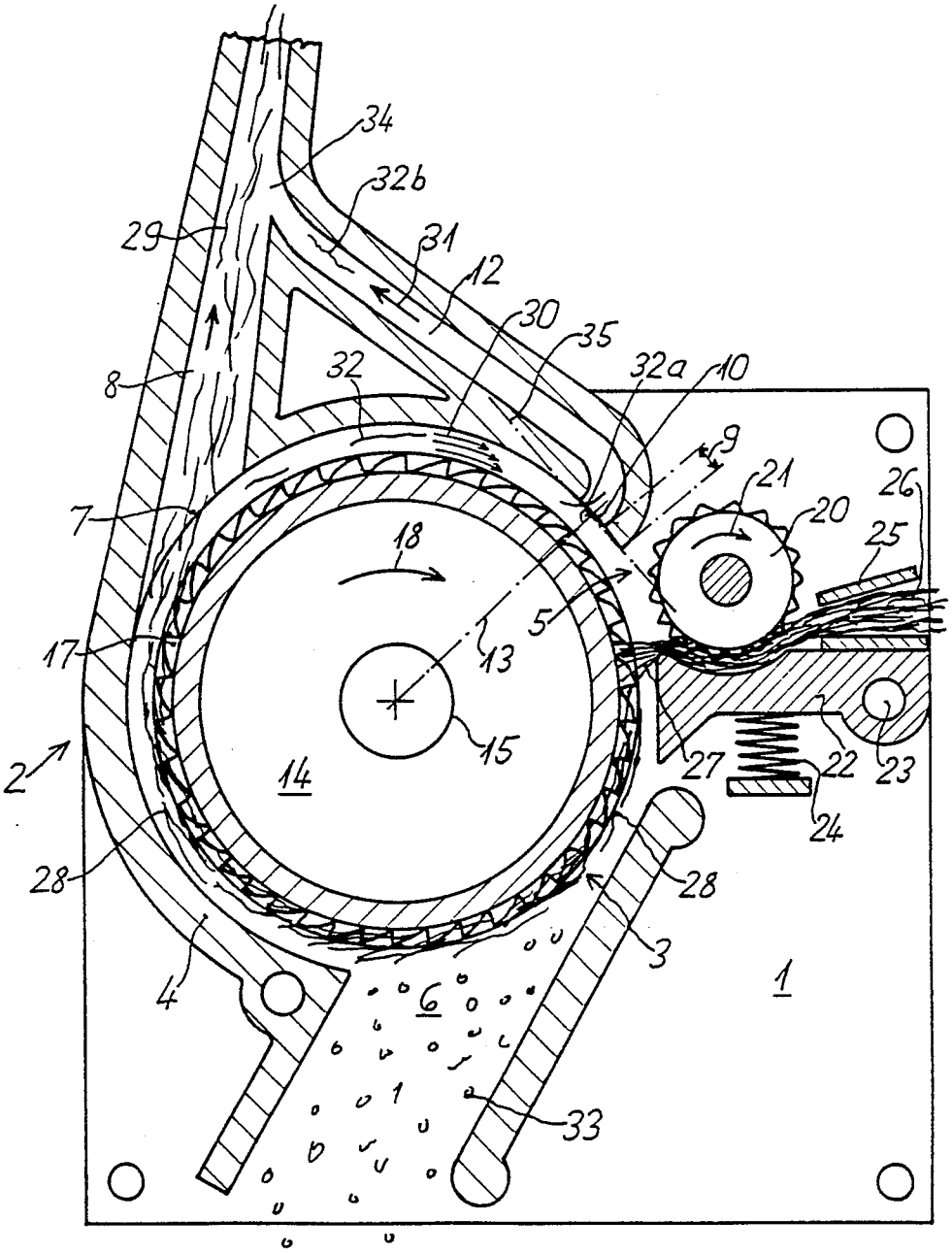
FIG. 1 is a vertical sectional view of one embodiment of the sliver feeding and opening device of the present invention.
Figure 2:
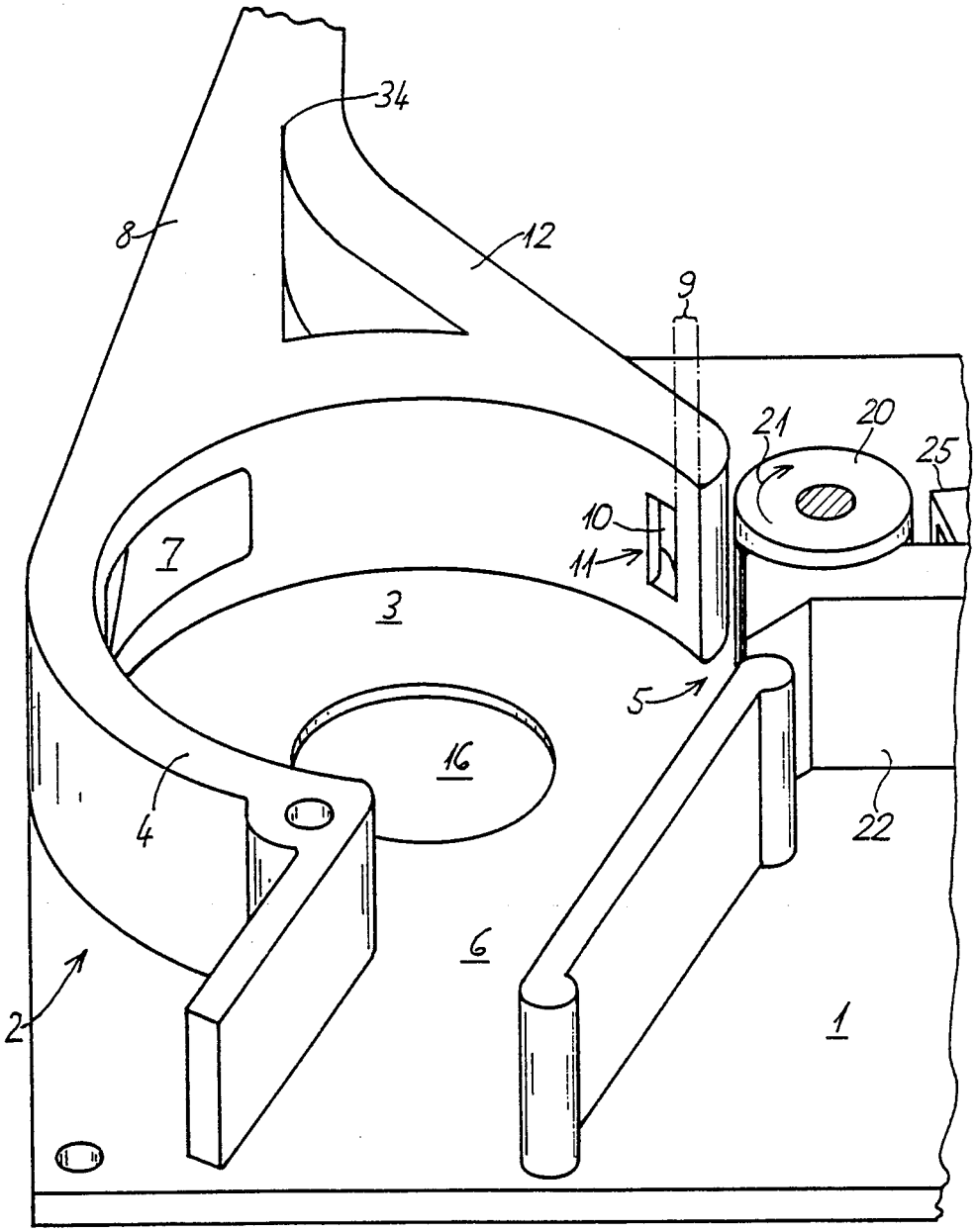
FIG. 2 is a front perspective view of the one embodiment of the sliver opening and feeding device shown in FIG. 1, with the opening roller not shown.

In FIGS. 1 and 2, one embodiment of the sliver opening and feeding device 1 of the present invention is illustrated. A housing 2 includes an interior chamber 3 having a generally cylindrical wall 4. An opening roller 14 is rotatably disposed in the housing 2 concentric with the wall 4 and is rotatable in an opening direction 18 about an axis 15. The opening roller 14 is provided with a plurality of saw tooth-like combing elements uniformly distributed about its outer circumference for combing sliver to effect separation and parallel orienting of the individual fibers of the sliver.

The sliver feeding and opening device 1 additionally includes an intake opening 5 for the intake of a sliver 26 into the chamber 3. A sliver feed roller 20 is rotatably supported on the sliver feeding and opening device for rotation in an intake direction 21 to feed the sliver 26 through the intake opening 5. A guide plate 22 is pivotably mounted by a pivot 23 and is biased by a spring 24 toward the sliver feed roller 20, whereby the guide plate 22 automatically adjusts to the changing forces exerted by the sliver 26 passing between the guide plate 22 and the sliver feed roller 20. A compressing member 25 initially compresses the incoming sliver 26 before its passage between the sliver feed roller 20 and the guide plate 22.

The sliver feeding and opening device 1 further includes a debris discharge conduit 6 opening into the chamber 3 downstream from the intake opening 5 in the opening direction 18 for the discharge of dirt and other debris from the chamber 3. The sliver feeding and opening device 1 additionally includes an outlet passage means 8 extending from an outlet opening 7 in the chamber 3 to the rotor (not shown) of the open-end spinning machine for the passage therethrough of separated sliver fibers. The outlet opening 7 is located downstream from the debris discharge conduit 6 and the intake opening 5 in the opening direction 18. Due to a pressure differential between the rotor and the sliver feeding and opening device 1, an outlet stream of air flowing from the chamber 3 through the outlet opening 7 toward the rotor exerts a suction force on the sliver fibers in the vicinity of the outlet opening 7 to draw these fibers into the outlet passage means 8 for passage therethrough to the rotor, such as illustrated by the fiber 29 in FIG. 1.

The sliver opening and feeding device 1 additionally includes an intermediate opening 10 in the chamber wall 4 at a location downstream of the outlet opening 7 and upstream of the intake opening 5 with respect to the opening direction 18. The intermediate opening 10 is located at a spacing 9 approximately in the range of one millimeter to five millimeters and preferably less than three millimeters, from the intake opening 5. As seen in FIG. 2, the intermediate opening 10 is formed as a slot 11 having its longitudinal extent generally parallel to the axis 15 of the opening roller 14 and substantially equal to the axial extent of the opening roller. An air stream reduction conduit 12 extends from the intermediate opening 10 to an opening 34 at the outlet passage means 8 for conducting air from the chamber 3 through the intermediate opening 10 for travel in the direction of the arrow 31 through the conduit 12 to the outlet passage means 8.

The circumferential extent of the slot 11 with respect to the axis 15 is selected in correspondence with the characteristics of the sliver to be handled by the sliver feeding and opening device 1 and, additionally, in correspondence with the tangential orientation of the intermediate opening 10 with respect to the chamber 3. Generally, the circumferential extent of the slot 11 is approximately in the range of 0.5 to 5 millimeters and is preferably under 3 millimeters. The initial portion of the air stream reduction conduit 12 extending from the intermediate opening 10 is generally centered on a radial line 13 extending from the axis 15 of the opening roller 14 and perpendicular to a tangent 35 generally aligned with the intermediate opening 10.

The sliver feeding and opening device 1 operates as follows. The opening roller 14 is rotated in the opening direction 18 while the sliver 26 is fed by the sliver feed rollers 20 into the chamber 3 through the intake opening 5. The fibers 27 of the incoming sliver 26 are preferably oriented generally radially with respect to the opening roller 14 for optimal opening by the combing elements 17 of the opening roller 14. The sliver fibers contacted by the combing elements 17 such as, for example, the fibers 28 shown in FIG. 1, are transported by the rotating action of the opening roller 14 in the opening direction 18 proximate the debris discharge conduit 6. Centrifugal forces acting on the fibers 28 drive dirt 23 in the fibers 28 radially outwardly with respect to the chamber 3 into the debris discharge conduit 6 for collection in a debris collection device (not shown). The sliver fibers 28 are carried by the action of the rotating opening roller past the debris discharge conduit to the vicinity of the outlet opening 7, whereupon the outlet air stream entrains the now-separated and generally parallel oriented fibers 28 and conducts these fibers through the outlet opening 7 and thereafter along the outlet passage means 8 to the rotor.

The rotating action of the opening roller 14 creates an air stream 30, shown in FIG. 1, which revolves about the axis 15 in the region between the combing element 17 of the opening roller 14 and the wall 4 of the chamber 3. The revolving air stream 30 can become especially pronounced in the extent between the outlet opening 7 and the intake opening 5 in the opening direction 18. As can be understood, the revolving stream of air 30, if unchecked, would collide with the incoming fibers 27 of the sliver 26 and thereby disrupt the orderly feeding of the fibers 27 at their preferred radial orientation with respect to the combing element 17 of the opening roller 14. To therefore desirably minimize the disruptive impact of the revolving stream of air 30 which inherently arises due to the rotating action of the opening roller 14, the air stream reduction conduit 12 diverts the revolving air stream 30 to prevent further travel of the revolving air stream in the opening direction 18 toward the intake opening 5.

The diversion of the revolving air stream 30 into the air stream reduction conduit 12 occurs due to the suction action created in the conduit 12 by the pressure differential between the rotor and the chamber 3. Specifically, the lower pressure of the rotor relative to the chamber 3 causes air to flow in the direction indicated by the arrow 31 in the air stream reduction conduit 12, thereby creating a suction action at the intermediate opening 10 which acts on the revolving air stream 30 thereat. Since the revolving air stream 30 is diverted by the air stream reduction conduit 12 before reaching the intake opening 5, the incoming fibers 27 of the sliver 26 are not subjected to the adverse action of the revolving air stream 30. Moreover, the diversion of the revolving air stream 30 produces the additional benefit of conducting those sliver fibers which have been carried beyond the outlet opening 7 by the revolving air stream 30 to the outlet passage means 8. For example, as seen in FIG. 1, some of the sliver fibers 32 are entrained by the revolving air stream 30 and are thus not effectively engaged by the outlet air stream to exit the chamber 3 with the other sliver fibers for passage to the rotor. As can be understood, these entrained sliver fibers 32 would interfere with the orderly feeding of the sliver fibers 27 at the intake opening 5 if not diverted or otherwise handled before reaching the intake opening 5. The diverting travel of the revolving air stream 30 through the intermediate opening 10 into the air stream reduction conduit 12 acts to carry the entrained fibers 32, such as shown by the fiber **32*a* in FIG. 1, through the intermediate opening 10 into the air stream reduction conduit 12 for passage therethrough, as shown by the fiber 32***b*, to join the other sliver fibers 29 in the outlet passage means 9 for transport to the rotor. Accordingly, sliver fibers which would otherwise accumulate and interfere with the intake operation are, instead, conducted by the air stream reduction conduit 12 to join the other sliver fibers for passage to the rotor.

As seen in FIG. 1, the opening 34 of the air stream reduction conduit 12 into the outlet passage means 8 is preferably at an acute angle with respect to the direction of travel of the fibers 29 through the outlet passage means 8 to facilitate the smooth entry of the fibers 32*b* from the air stream reduction conduit 12 into the outlet passage means 8.

Figure 3:
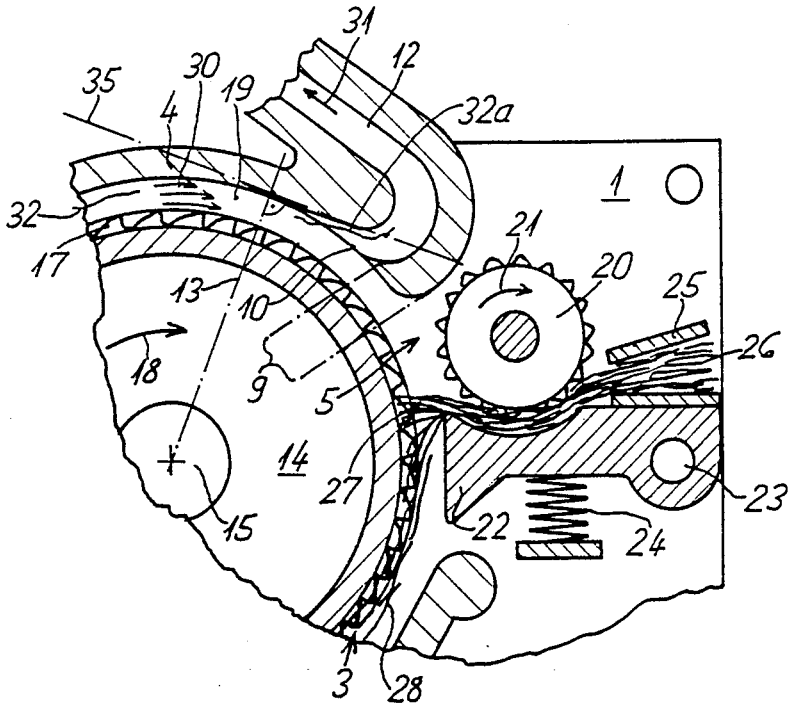
FIG. 3 is a partial vertical sectional view of another embodiment of the sliver opening and feeding device of the present invention.

In FIG. 3, another embodiment of the sliver opening and feeding device of the present invention is illustrated and is generally designated as 1. The sliver feeding and opening device 1 is identical to the sliver feeding and opening device illustrated with respect to the embodiment shown in FIGS. 1 and 2 except that the intermediate opening 10 and the initial portion of the air stream reduction conduit 12 extending from the intermediate opening 10 are differently configured. Specifically, the initial extent of the air stream reduction conduit 12 extending from the intermediate opening 10 extends in the direction generally parallel to a tangent 35 of the cylindrical wall 4 at a location thereon upstream of the intermediate opening 10 relative to the opening direction 18. This configuration is especially advantageous for guiding relatively long fibers from the revolving air stream 30 into the air stream reduction conduit 12. These relatively long fibers tend to remain in their generally extended dispositions throughout their travel through the air stream reduction conduit 12 and upon their entrance into the outlet passage means 9 for passage to the rotor.

Figure 4:
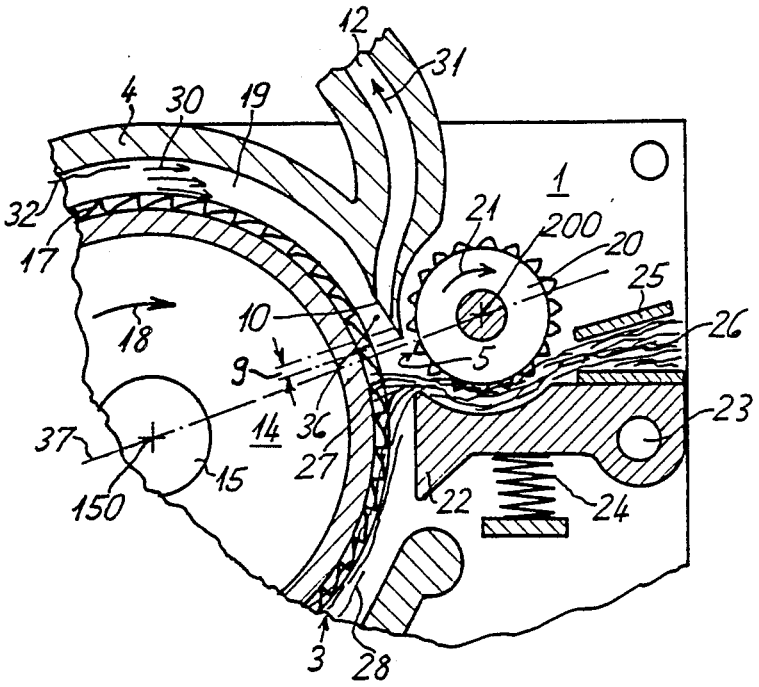
FIG. 4 is a partial view, in vertical section, of a further embodiment of the sliver opening and feeding device of the present invention.

In FIG. 4 a further embodiment of the sliver feeding and opening device of the present invention is illustrated and is generally designated as 1. The sliver feeding and opening device 1 in the embodiment in FIG. 4 is identical to the embodiment of the sliver feeding and opening device shown in FIGS. 1 and 2 except that the intermediate opening 10 and the initial extent of the air stream reduction conduit 12 extending from the intermediate opening 10 are differently configured. Specifically, the intermediate opening 10 is located at a predetermined spacing from a line 37 extending from the axis 150 of the opening roller 14 through the axis 200 of the opening roller 20. Additionally, the intermediate opening is located at a relatively reduced spacing 9 from the intake opening 5. The radial spacing of the intermediate opening 10 from the axis 150 of the opening roller 14 is dimensioned relative to the region extending between the outlet opening 7 and the intermediate opening 10 such that the radial spacing of the cylindrical wall 4 from the outer circumference of the opening roller 14 is greater than the radial spacing of intermediate opening 10 from the outer circumference of the opening roller 14. This relatively narrower spacing of the cylindrical wall 4 from the opening roller 14 immediately before the intake opening 5 tends to reduce the undesirable suctioning of air through the intake opening 5 into the intermediate opening 10 due to the passage of the air in the direction 31 through the air stream reduction conduit 12.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A sliver feeding and opening device for feeding separated sliver fibers to the rotor of an open-end spinning machine, comprising:

a housing having an interior chamber with a generally cylindrical wall;

an intake opening for the intake of sliver into said chamber housing;

an outlet passage means extending from said housing chamber to the rotor for the passage therethrough of separated sliver fibers which become entrained in an outlet stream of air flowing from said housing chamber to the rotor in response to a pressure differential therebetween, said outlet passage means including an outlet opening at said chamber wall;

an opening roller having an axis and rotatably disposed in said housing chamber concentric with said wall and rotatable in an opening direction to effect opening of sliver following the intaking thereof through said intake opening during transport of the sliver to said outlet opening, the rotation of said opening roller producing a stream of air revolving concentrically with said opening roller and said wall in the region between said opening roller and said wall;

an intermediate opening in said chamber wall at a location downstream of said outlet opening and upstream of said intake opening with respect to said opening direction; and an air stream reduction conduit extending from said intermediate opening to said outlet passage means for conducting air from said revolving stream of air to said outlet passage means.

2. The sliver feeding and opening device according to claim 1 and characterized further in that said air stream reduction conduit extends at an acute angle from said outlet passage means with respect to said outlet stream of air to facilitate the smooth entry of air conducted by said air stream reduction conduit into said outlet passage means.

3. The sliver feeding and opening device according to claim 1 and characterized further in that said intermediate opening has a longitudinal extent substantially equal to the axial extent of said opening roller.

4. The sliver feeding and opening device according to claim 1 and characterized further in that said intermediate opening is in the form of a slot having its longitudinal extent generally parallel to said axis of said opening roller.

5. The sliver feeding and opening device according to claim 1 and characterized further in that said air stream reduction conduit extends from said intermediate opening generally in the direction of a line extending through the axis of said opening roller and generally perpendicular to a tangent of said chamber wall at said intermediate opening location.

6. The sliver feeding and opening device according to claim 1 and characterized further in that the radial extent of the region between said outlet opening and said intermediate opening with respect to said opening roller is substantially constant and the radial extent between said intermediate opening and said opening roller is less than said radial extent of said region between said outlet opening and said intermediate opening.

* * * * *